US005339287A

United States Patent [19]

Bauer

[11] Patent Number: 5,339,287

[45] Date of Patent: Aug. 16, 1994

[54] AIRBORNE SENSOR FOR LISTENING TO ACOUSTIC SIGNALS

[75] Inventor: Andrew B. Bauer, Orange, Calif.

[73] Assignee: Northrop Grumman Corporation, Los Angeles, Calif.

[21] Appl. No.: 49,796

[22] Filed: Apr. 20, 1993

[51] Int. Cl.[5] ..... H04R 23/00

[52] U.S. Cl. ..... 367/140; 367/901; 381/86; 381/91; 381/188; 381/205

[58] Field of Search ..... 381/86, 91, 188, 205; 367/901, 906, 140

[56] References Cited

U.S. PATENT DOCUMENTS 4,388,502 6/1983 Cohn ..... 179/179

OTHER PUBLICATIONS

"Static-pressure probes that are theoretically insensitive to pitch, yaw and Mach number", A. M. O. Smith and A. B. Bauer, Jan. 5, 1970.

*Primary Examiner*—J. Woodrow Eldred

*Attorney, Agent, or Firm*—Terry J. Anderson; Robert B. Block; Karl J. Hoch, Jr.

[57] ABSTRACT

An acoustic sensor for use in a typical atmospheric condition, which contains both winds and turbulence, such as a wind and turbulence encountered on the exterior surface of a moving airborne flight vehicle includes a probe housing having a streamlined shape and a set of indentations in the exterior surface thereof extending inwardly located at a particular longitudinal location, radial airflow passages nested in respective ones of the concave indentations, the passages merging at a central manifold of the passages, wherein the particular longitudinal location is such as to minimize noise attributable to fluctuations in the wind in a longitudinal direction, and wherein the concave indentations have indentation depths such as to minimize noise attributable to wind transverse to the probe.

11 Claims, 1 Drawing Sheet

AIRBORNE SENSOR FOR LISTENING TO ACOUSTIC SIGNALS

BACKGROUND OF THE INVENTION

1. Technical Field

The invention is related to airborne acoustic sensors of the type including a microphone on an airborne vehicle such as a glider, and more particularly to such sensors having low noise characteristics.

2. Background Art

Airborne acoustic sensors or microphones are limited in their performance because of air turbulence around the sensor which induces noise. Some turbulence will always be present which creates great noise picked up by the microphone.

Static pressure probes which are virtually insensitive to pitch, yaw and speed have been disclosed by A. M. O. Smith and A. B. Bauer, "Static-pressure probes that are theoretically insensitive to pitch, yaw and Mach number," *J. Fluid Mechanics*, (1970), vol. 44, part 3, pages 513–528, in which the housing has a clover-leaf cross-sectional shape with four concave indentations, each one of four radial ports in the housing nested in a respective one of the four indentations. As disclosed in that publication, the principal advantage is that the static pressure at the intersection of the four radial ports (at the center of the housing) is insensitive to cross-wind velocities. If the four radial ports are located at a longitudinal point along the housing at which the pressure coefficient is zero (that is, where the pressure at the housing surface equals the ambient atmospheric pressure), then a theoretically perfect measurement of static pressure is obtained at the intersection of the four microphone 3 ports. However, static pressure probes are useful for measuring speed, but have nothing to do with sensing sound waves or acoustic signals.

SUMMARY OF THE DISCLOSURE

The present invention is a microphone housing which is aerodynamically shaped (like a bullet) with a longitudinal shape pointed along the direction of travel of an airborne vehicle on which it is mounted. The housing includes four radial microphone ports or passages extending from the surface of the housing toward the longitudinal axis of the housing, at which point a microphone is located. The cross-sectional shape of the housing viewed along the longitudinal axis is a clover-leaf shape. The cross-sectional shape of the housing viewed from the side is a thin pointed shape selected so that the pressure coefficient is zero at the longitudinal location of the four radial microphone ports.

The advantage of the clover-leaf cross-sectional shape is that the acoustic signal sensed at the intersection of the radial ports is virtually free of noise attributable to atmospheric turbulent cross-velocity components. The advantage of locating the four radial ports at a longitudinal location at which the pressure coefficient is zero is that the acoustic signal sensed at the intersection of the four radial ports is virtually free of noise attributable to atmospheric turbulent axial velocity fluctuations. The result is that the airborne acoustic probe of the present invention is virtually insensitive to turbulence-induced noise.

DETAILED DESCRIPTION OF THE PREFERRED EMBODIMENT

Figure 1:
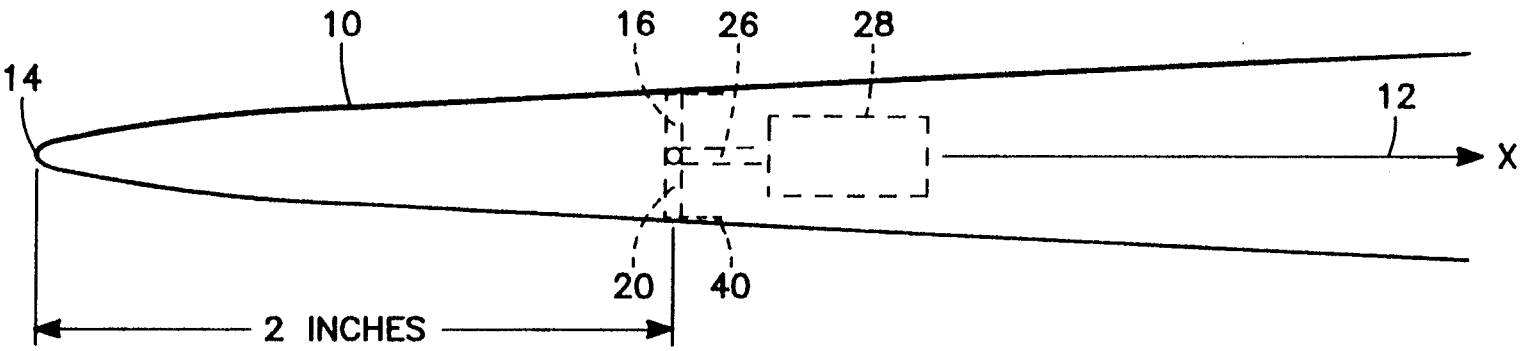
FIG. 1 is a side view of the airborne acoustic probe of the invention.
Figure 2:
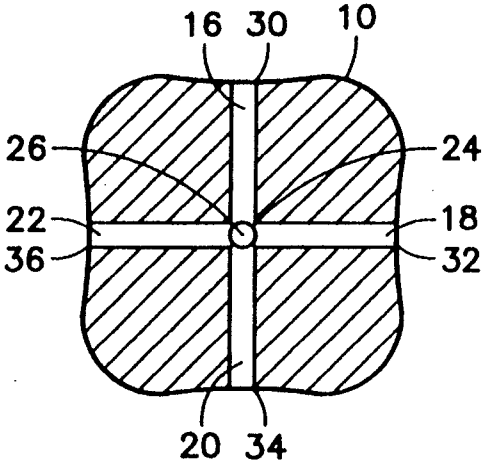
FIG. 2 is a cross-sectional end view of the airborne acoustic probe of FIG. 1.

Referring to FIGS. 1 and 2, a streamline aerodynamic housing 10 having symmetry about a longitudinal axis 12 has a round end point 14 facing the direction of travel by an airborne vehicle to which the housing 10 is attached. In the embodiment of FIG. 1, there are four microphone passages 16, 18, 20, 22 extending radially inward toward the longitudinal axis 12 from four equidistant openings in the surface of the housing 10. The radial passages 16–22 meet at an intersection 24 connected by a very short longitudinal passage 26 to a microphone 28. If the probe housing 10 is solid, the passages 16–22 are drilled therethrough while if the housing 10 is hollow the passages 16–22 are tubes or the like.

Figure 3:
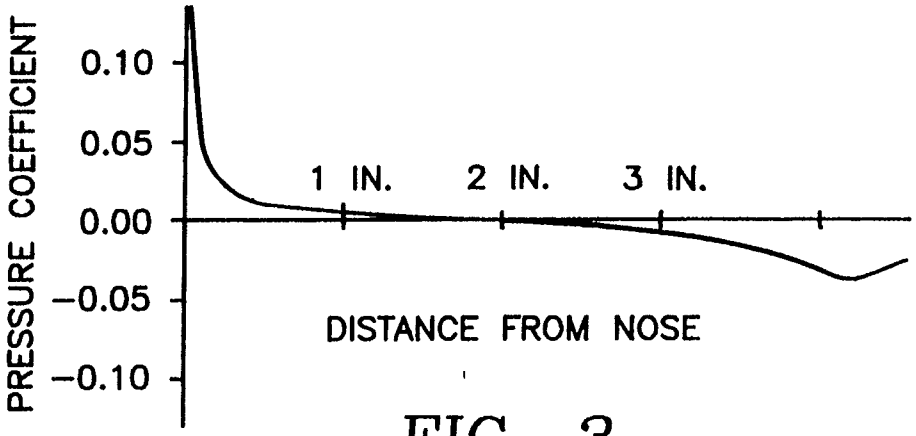
FIG. 3 is a graph of the pressure coefficient as a function of location along the longitudinal axis of the probe of FIG. 1, illustrating the optimum location for the radial microphone ports.

The longitudinal shape of the housing 10 (illustrated in the side view of FIG. 1) is selected so that at the location of the four radial microphone passages 16–22 on the longitudinal axis 12, the pressure coefficient is zero. In a preferred embodiment, this is accomplished using well-known computational fluid mechanics methods. As a typical example, the shape of FIG. 1 was produced by calculations using an airspeed of 185 feet per second at an altitude of 5000 feet, and also by specifying in the computational fluid mechanics method a uniform aerodynamic line source of line strength 31.83 cu. in. per second between 0.006 inches back from the tip 14 and 4.206 inches therefrom and a second uniform aerodynamic line source of line strength 0.84 cu. in. per second between 2.356 inches back from the tip 14 and 3.506 inches therefrom. With this shape, the coefficient of pressure is zero at the surface of the housing in areas from 1.5 inches to 2.3 inches back from the tip 14 measured along the axis 12, as illustrated in the graph of FIG. 3. In this embodiment, the radial passages 16–22 are longitudinally displaced back from the tip 14 by 2.25 inches. This aft locatoin was picked so that the passages 16–22 would be close to a region with adequate space for the microphone 28. Of course, the skilled worker can readily define other housing shapes having different locations at which the coefficient of pressure is zero, any of which would be suitable for carrying out the present invention.

In the vicinity of the four radial passages 16–22, the housing has the cloverleaf cross-sectional shape illustrated in FIG. 2. In the embodiment of FIG. 2, the cloverleaf cross-sectional shape is generated in accordance with the following equation:

$$r(x,\theta)=R(x)\{1-a(x)\cos^2(2\theta)\}/\{1-a(x)+0.375a^2(x)\}$$

where x is a location along the longitudinal axis 12, R(x) is the mean radius of the cross-sectional shape of FIG. 2 and a(x) determines the eccentricity of the cloverleaf shape of FIG. 2. This eccentricity corresponds to the depth of the four radial indentations 30, 32, 34, 36 in the surface of the housing 10 in which the four radial passages 16–22 nest. In this embodiment, the eccentricity coefficient a(x) must be selected to be 0.1745 in regions close to the holes 16–22 in order for the pressure sensed at the intersection passage 26 to be insensitive to cross-wind turbulence.

Other variations are possible. For example, rather than the axially symmetrical shape of FIG. 2, a rounded diamond shape (corresponding to that described in the above-referenced publication) can be employed, in which case a(x)=0.1975 for optimum performance. However, it is felt that the cloverleaf embodiment of FIG. 2 has superior performance characteristics. The above equation can be modified, for example, by substituting another function (such an exponent) in place of the cosine. Finally, the number of indentations and radial passages can be increased by integral factors to 8 or 12 and so forth, although doing so increases the difficulty of manufacture and therefore is not preferable.

The cloverleaf cross-sectional shape of FIG. 2 (or variations thereof) need only be present near the longitudinal location of the radial passages 16–22, and other portions of the housing 10 may have a different (e.g., round) cross-sectional shape.

In order to guard against to formation of rain droplets blocking the passages 16–22, small grooves 40 may be cut in the probe surface for a short distance parallel to and extending back from each radial passage 16–22 with a depth nearly equal to the passage diameter.

In general, size is a key factor in determining performance, and better performance is attained with smaller sized probes. The limit, of course, is the size of the microphone 28 to be held inside the probe housing 10.

While the invention has been described in detail by specific reference to preferred embodiments, it is understood that variations and modifications thereof may be made without departing from the true spirit and scope of the invention.

What is claimed is:

1. An acoustic sensor for use in an atmospheric condition which contains both winds and turbulence encountered on the exterior surface of a moving airborne flight vehicle comprising:

a probe housing having a streamlined shape extending longitudinally along an axis oriented close to the direction of flight of the said vehicle, said probe housing having a set of spaced plural concave indentations in the exterior surface thereof extending inwardly in a direction toward said axis and located at a particular longitudinal location along said axis;

a set of spaced radial airflow passages extending inwardly from respective openings in a surface of said probe housing toward said axis and located at said particular longitudinal location along said axis, whereby said respective openings are located in respective ones of said concave indentations, means forming a central manifold within said probe housing, said passages merging at said central manifold;

a microphone coupled to said central manifold to sense acoustic signals in said manifold;

wherein said particular longitudinal location along said axis is such as to minimize in said acoustic signals noise attributable to fluctuations in said wind in a direction along said axis, and wherein said concave indentations have indentation depths such as to minimize in said acoustic signal noise attributable to wind transverse to said axis.

2. The acoustic sensor of claim 1 wherein said probe housing has a symmetrical and cross-sectional shape in the vicinity of said passages and said passages are equidistantly spaced and there are **4*n*** passages, wherein n is an integer.

3. The acoustic sensor of claim 2 wherein n=1 and said passages are located at 90 degree intervals about said axis.

4. The acoustic sensor of claim 3 wherein:

said probe housing has an end cross-sectional shape in the vicinity of said passages corresponding to the following equation:

$$r(x,\theta)=R(x)\{1-a(x)\cos^2(2\theta)\}/\{1-a(x)+0.375a^2(x)\}$$

wherein x is a location along said axis, R(x) is the mean radius of said cross-sectional shape and a(x) is the depth of said indentations.

5. The acoustic sensor of claim 4 wherein a(x) is at least approximately 0.1745.

6. The acoustic sensor of claim 1 wherein said probe housing has an eccentric end cross-sectional shape in the vicinity of said passages.

7. The acoustic sensor of claim 6 wherein said eccentric cross-sectional shape is a diamond shape.

8. The acoustic sensor of claim 1 wherein said probe housing has a short groove in the surface thereof extending downstream from each indentation whereby to drain water drops from said passages.

9. An acoustic sensor for use in a wind comprising:

a probe housing having a streamlined shape extending longitudinally along an axis oriented in a general direction of said wind, said probe housing having a set of spaced plural concave indentations in the exterior surface thereof extending inwardly in a direction toward said axis and located at a particular longitudinal location along said axis;

a set of spaced radial airflow passages extending inwardly from respective openings in a surface of said probe housing toward said axis and located at said particular longitudinal location along said axis, whereby said respective openings are located in a respective ones of said concave indentations, said passages merging at a central manifold of said passages;

a microphone coupled to said central manifold to sense acoustic signals in said manifold;

wherein said probe housing has an end cross-sectional shape in the vicinity of said passages corresponding to the following equation:

$$r(x,\theta)=R(x)[1-a(x)\cos^2(2\theta)\}/\{1-a(x)+0.375a^2(x)\}$$

wherein x is a location along said axis, R(x) is the mean radius of said cross-sectional shape and a(x) is the depth of said indentations.

10. The acoustic sensor of claim 9 wherein a(x) is at least approximately 0.1745.

11. The acoustic sensor of claim 9 wherein said probe housing has a short groove in the surface thereof extending downstream from each indentation whereby to drain water drops from said passages.

* * * * *